United States Patent [19]

Zurbruggen

[11] 4,149,668

[45] Apr. 17, 1979

[54] CENTRIFUGAL SEPARATOR WITH OUTLET VALVES

[75] Inventor: Hugo Zurbruggen, Oelde, Fed. Rep. of Germany

[73] Assignee: Westfalia Separator AG, Oelde Westfalen, Fed. Rep. of Germany

[21] Appl. No.: 867,547

[22] Filed: Jan. 6, 1978

[30] Foreign Application Priority Data

Jan. 17, 1977 [DE] Fed. Rep. of Germany ..... 2701623

[51] Int. Cl.[2] ..... B04B 1/18

[52] U.S. Cl. ..... 233/20 R

[58] Field of Search ..... 233/20 R, 20 A, 19 R, 233/19 A

[56] References Cited

U.S. PATENT DOCUMENTS

| | | | |
|---|---|---|---|
| 2,136,127 | 11/1938 | Fawcett | 233/20 A |
| 2,321,887 | 6/1943 | Ayres | 233/20 R |
| 2,873,910 | 2/1959 | Steinacker | 233/20 R |
| 3,145,223 | 8/1964 | Little | 233/20 R |
| 3,825,176 | 7/1974 | Hemfort | 233/20 R |
| 4,054,244 | 10/1977 | Paschedag | 233/20 A |

FOREIGN PATENT DOCUMENTS

| | | | |
|---|---|---|---|
| 777153 | 6/1957 | United Kingdom | 233/20 R |

*Primary Examiner*—George H. Krizmanich

*Attorney, Agent, or Firm*—Sprung, Felfe, Horn, Lynch & Kramer

[57] ABSTRACT

A centrifugal separator having outlet valves 11 (FIG. 2) at the periphery of the drum for discharge of concentrate. The valve piston 20 is shielded from drum pressure by the valve casing 17 and the position of the valve piston is controlled by control fluid introduced through bore 26. The valve nozzle 18 is provided with a notch 19 for control of the valve opening size. This facilitates control of the rate of discharge of concentrate in dependence of the operating conditions.

9 Claims, 4 Drawing Figures

CENTRIFUGAL SEPARATOR WITH OUTLET VALVES

BACKGROUND

Figure 1:
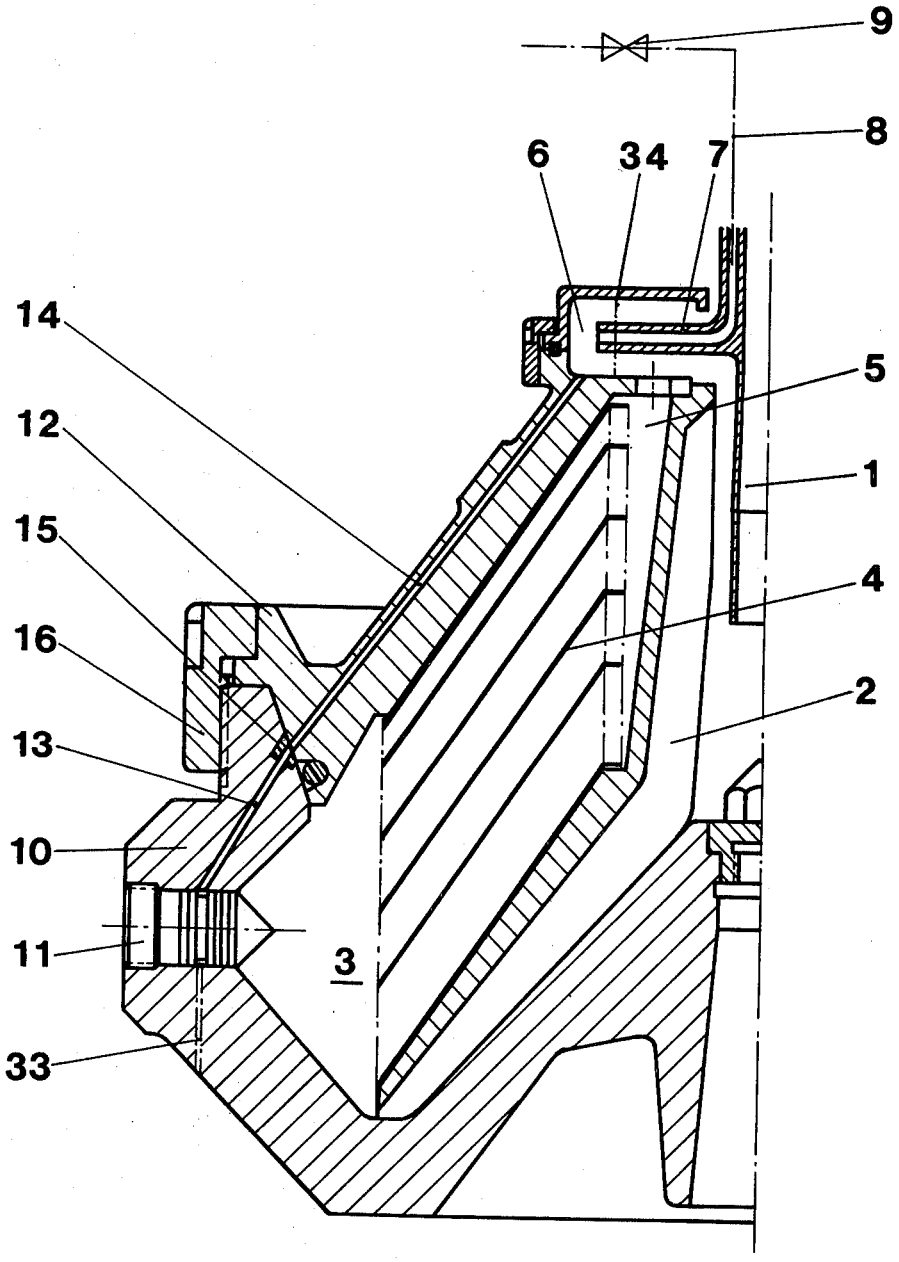

The invention relates to a centrifugal separator for the concentration of suspended solids having outlet valves disposed uniformly on the circumference preferably in the plane of the greatest separating chamber diameter. The outlet valves have movable valve pistons which are shielded from the pressure of the drum charge by a valve casing and which close nozzle orifices by centrifugal force during operation of the drum at full rotatory speed and assume an open position upon the introduction of a control liquid.

Centrifugal separators of such construction are known. It is a disadvantage of these drums that the valve provided for the removal of concentrate can assume either a closed or an open position, and fine regulation of the nozzle aperture size is not possible since the valves have conical seats which are not suitable for fine adjustment according to the concentration and particle size of the solids.

When suspended solids are to be concentrated, a high concentration of the solids is desirable, the nozzle aperture size and the number of nozzles being determined on the basis of a constant rate of flow and a constant solid particle size. Under the high liquid pressure in the drum, therefore, it is necessary, especially in the case of low rates of flow of the solids, to have very small nozzle apertures, e.g., under 1 mm in diameter, if they are disposed at the periphery of the drum, in order to achieve a sufficient concentration of the solids. Larger nozzles can be used only if the nozzles are disposed on a smaller drum diameter, and if the solid particles are of a light consistency and slide off inwardly on a smaller diameter. The nozzles, however, must be disposed at the periphery of the drum when the particles are of a higher specific weight and are unable to slide off on a smaller diameter.

In nozzles of small aperture size, however, even if the material has been well screened beforehand, it is easily possible for the nozzles to become clogged, for example by the loosening of deposits of solids. This not only impairs the operation of the centrifuge, but can result in imbalances which can lead to considerable damage. The danger is all the greater the smaller the nozzle aperture is, and therefore apertures are not made smaller than a certain minimum diameter. When the solid content of the liquid being separated is low, the result of this is that the use of nozzle-type centrifuges is possible only by the use of partially disadvantageous measures, such as the use of a smaller number of nozzles or of the recycling of the concentrate. One particular disadvantage in the case of a fixed nozzle cross section is that the amount of solid substance produced must not vary during operation, because otherwise either the concentrate becomes too thin, or nozzle clogging occurs.

THE INVENTION

The object of the invention consists in constructing the outlet valves of the separator such that, during operation, the nozzle apertures will automatically adjust to the concentration being produced and automatically prevent any possible clogging of the nozzles.

The object of the invention is accomplished in that the nozzle orifice consists of a wedge-shaped, calibrated notch, the notch in the nozzle is closed and opened by a movably disposed valve piston, and the valve piston communicates with the paring chamber through passages.

In a special embodiment of the wedge-shaped notch, the latter is closed towards the periphery of the drum and has an enlarged cross section towards the drum axis.

The construction of the nozzle in accordance with the invention with a wedge-shaped calibrated notch permits a constant fine regulation of the nozzle cross section during operation, an automatic adjustment of the nozzle cross section being made possible in accordance with the liquid pressure prevailing in the paring chamber.

The liquid pressure is determined on the one hand by the depth of immersion of the paring member disposed in the paring chamber by means of a throttling member disposed in the clear phase outlet line, and on the other hand by the rate of flow of the liquid carried off by the paring member. As the rate of flow of liquid increases, the depth of immersion of the paring member is increased by the shift of the internal liquid level towards the drum axis, and thus the pressure of the liquid on the valve piston connected by a connecting passage is also increased; consequently, a stronger opening pressure is exercised on the piston, which brings about an enlargement of the cross section of the groove in the nozzle. In the case of reduced rate of flow, the internal liquid level shifts outwardly, the liquid pressure or opening pressure, as the case may be, diminishes, and this brings about a reduction of the groove cross section.

The special construction of the valve piston additionally produces an opening force proportional to the viscosity or density of the discharged concentrate, which exercises a greater force on the valve piston as the viscosity or density increases and a lesser force as the viscosity or density decreases, so that an automatic regulation of the groove cross section is achieved according to the viscosity or density of the concentrate.

In conjunction with a means of measurement of the viscosity or density in the concentrate discharge, a regulation of the depth of immersion of the paring member and hence of the groove cross section can be achieved by means of the throttling member provided in the discharge line.

A clogged nozzle, in the event of an excessive concentration, for example, can also produce turbidity in the clear phase or an imbalance in the separator drum, so that by means of a turbidity meter or an imbalance switch, for example, the throttling member in the discharge line can be shifted to a highly throttled or closed position and thus a maximum nozzle cross section can be opened up, resulting in an automatic clearing of the smaller nozzle cross section.

Figure 2:
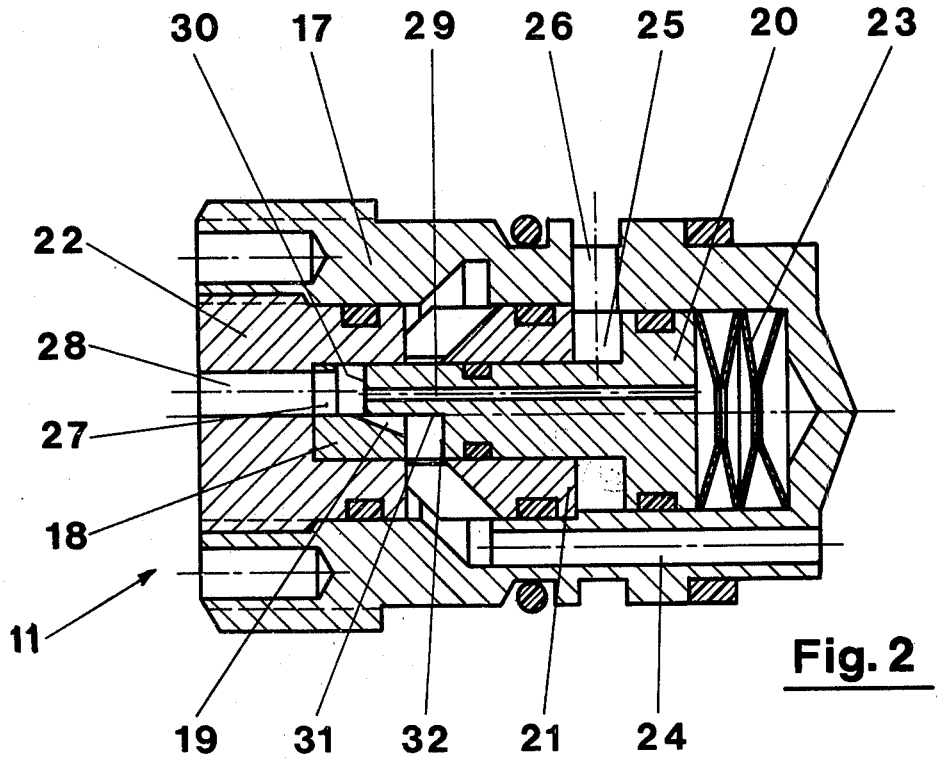
Figure 3:
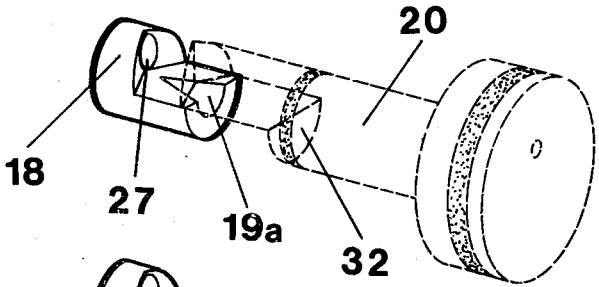
Figure 4:
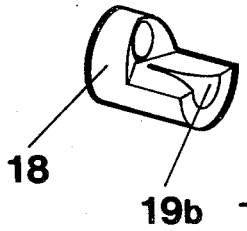

An example of the embodiment of the invention is represented in the drawing, wherein:

FIG. 1 is a longitudinal cross sectional view of the left half of a centrifugal separator constructed in accordance with the invention, FIG. 2 is an enlarged cross section taken through the half-opened outlet valve, FIG. 3 is an enlarged perspective view of a nozzle with valve piston, and FIG. 4 is an enlarged perspective view of another embodiment of the wedge-shaped groove in the nozzle.

Referring now to FIG. 1, the solids-containing raw liquid is fed through the feed tube 1 centrally into the distributing chamber 2, flows from there into the separating chamber 3 from which the specifically light liquid component flows inwardly through the plate insert 4 for further clarification, passes through the passage 5 into the paring chamber 6, and is carried out by the paring means 7. In the clear phase discharge line there is a throttling member 9 and a means for the continuous testing of the clear phase, e.g., a turbidity meter.

The specifically heavier solids separated in the separating chamber 3 are spun radially towards the periphery of the drum and collect in the outer separating chamber. In the drum 10 the outlet valves 11 are equally spaced along the circumference. In the drum 10 and in the drum cover 12 are passages 13 and 14, sealed against one another by sealing rings 15, for the feeding of the control liquid from the paring chamber 6. The drum is closed by the cover 12, which is joined to the drum 10 by means of the threaded ring 16. The solid concentrate is ejected through the outlet valves 11 and captured in a sludge catcher which is not shown, the concentrate being continuously tested by a known viscosity or density measuring means which is not shown.

FIG. 2 shows an enlarged cross section taken through the half-opened outlet valve 11, which consists essentially of the valve casing 17, a nozzle 18 provided in accordance with the invention with a calibrated, wedge-shaped notch 19 and a valve piston 20, the guide 21, the nozzle holder 22, and several seals. The valve piston 20 is biased to the closed position under light pressure from cup springs 23. In the valve casing 17 there are passages 24 for carrying out the solids, and an annular passage 25 having bores 26 which communicate with the annular passage 25.(XX) Solids are carried out through the calibrated, wedge-shaped notch 19 in nozzle 18 when the valve piston 20 is in the open position, and they are discharged from the drum through the bores 27 and 28 in nozzle 18 and nozzle holder 22. The passage 29 in valve piston 20 serves for venting. The guide 21 is mounted in a fixed position in the valve casing 17.

(XX) In addition, annular passage 25 communicates with passages 13 and 14 for the supply of control liquid from paring chamber 6.

FIG. 3 shows the nozzle 18 and its radially movable valve piston 20 in an enlarged perspective view, with the notch 19*a* having a uniformly conical shape.

FIG. 4 shows another shape of the calibrated notch in the nozzle 18, the notch being of paraboloid shape or other similar wedge-like shape.

The valve operates in the following manner: During operation, the front face 30 and bottom bearing surface 31 of the valve piston 20 carried movably and sealingly in valve housing 17 and in guide 21 closes the bore 27 under the action of the centrifugal force and the spring force, and thus prevents the emergence of liquid or concentrate from the solids chamber 3. As soon as the drum is charged with liquid, on the one hand the liquid and/or the concentrate exercises on the step 32 of valve piston 20 a radial opening force, and on the other hand an increasing opening force is exercised on the valve piston as the filling of the paring chamber 6 with liquid increases, this liquid acting on the valve piston through the passages 14 and 13 and annular passage 25. This force acting on the valve piston is controlled by the depth of immersion of the paring disk by the operation of the throttling member 9 in the clear phase discharge line 8, whereupon a displacement of the internal liquid level towards the drum axis takes place and thus the liquid pressure on the valve piston can be regulated. As the opening pressure on the valve piston 20 increases, the latter releases the calibrated notch 19 in the nozzle 18, so that the solid or the concentrate is carried out. The greater the pressure on the valve piston is, the larger will be the aperture in the nozzle. If the throttling position of the valve 9 in the discharge line 8 remains constant, the depth of immersion of the parking disk will then automatically vary as the discharge output varies, i.e., if the rate of flow of the liquid is great, the depth of immersion of the paring member 7 will be great and thus the opening pressure on the valve piston will be high and the aperture of the notch will be great, so that a greater amount of solid or concentrate will be able to be discharged.

Likewise, the size of the opening of the notch in the nozzle is reduced when the feed of liquid diminishes.

Furthermore, the nozzle aperture will vary automatically, independently of the rate of flow of the concentrate, in relation to the viscosity or density of the concentrate, the pressure of the concentrate increasing as the concentration and density on the step 32 of the valve piston increases, and decreasing accordingly when the concentration diminishes.

In one special embodiment, the annular passage 25 is in communication with a calibrated bore 33, so that a small amount of control liquid can be continuously carried out of the drum. This embodiment is desirable when the control liquid is not free of solid particles and thus the clogging of the annular passage is to be forestalled.

The discharge valve disposed in accordance with the invention is used not only in centrifugal separators for the concentration of suspended solids, but it can also be used in separators for the separation of two liquids with simultaneous concentration of the solid. Likewise, the discharge valve can be used on a small drum diameter.

SUMMARY

An improvement in a centrifugal separator suitable for the concentration of suspended solids having outlet valves for discharge of concentrate from the periphery of the separator. Each valve comprises means defining a passageway (24, 19, 27, 28) through the valve for said discharge including a valve nozzle 18, a movable valve piston 20 for cooperation with the nozzle for control of the flow rate through said passageway, and a valve casing 17 shielding the movable valve piston from the pressure of the drum charge. The valve pistons are urged toward closing of said passageway by centrifugal force during rotation of the drum. Means are provided for supplying a control liquid to the valves for urging the valve pistons toward opening of said passageways. The improvement comprises nozzles or valve pistons having a notch for control of the opening size in said passageways between the nozzles and valve pistons in dependence on the position of the valve piston. The separator comprises a paring chamber for removal of a fraction depleted in suspended solids separated in the drum, and the means for supplying control liquid includes passageways communicating the paring chamber with the valves. In a preferred embodiment each valve piston has a step (32) which is constantly acted on by the concentrate.

What is claimed is:

1. In a centrifugal separator suitable for the concentration of suspended solids having outlet valves for discharge of concentrate from the periphery of the separator, each valve comprising means defining a passageway through the valve for said discharge and including a valve nozzle, a movable valve piston for cooperation with the nozzle for control of the flow rate through said passageway, and a valve casing shielding the movable valve piston from the pressure of the drum charge, the valve pistons being urged toward closing of said passageway by centrifugal force during rotation of the drum, and means for supplying a control liquid to the valves for urging the valve pistons toward opening of said passageways, the improvement which comprises the nozzles or valve pistons having a notch for control of the opening size in said passageways between the nozzles and valve pistons in dependence on the position of the valve piston, the separator comprising a paring chamber for removal of a fraction depleted in suspended solids separated in the drum, said means for supplying control liquid comprising passageways communicating the paring chamber with the valves.

2. Separator of claim 1, wherein said notches are in the valve nozzles.

3. Separator of claim 2, the notch being closed towards the periphery of the drum and having an enlarged cross section towards the drum axis.

4. Separator of claim 1, each valve piston having a step disposed so as to be constantly acted upon by the concentrate.

5. Separator of claim 2, each notch being of uniformly conical construction.

6. Separator of claim 2, each notch being of paraboloid construction.

7. Separator of claim 1, said means for supplying control fluid further comprising a paring member communicated with the paring chamber for removal of said fraction from the paring chamber, an outlet line communicated with the paring member for discharge of said fraction, and a throttling member in said outlet line.

8. Separator of claim 1, said means for supplying control liquid comprising means defining an annular chamber for each valve, the drum having a calibrated bore communicating with the annular chamber for continuous flow of control fluid.

9. Separator of claim 4, said means for supplying control fluid further comprising a paring member communicated with the paring chamber for removal of said fraction from the paring chamber, an outlet line communicated with the paring member for discharge of said fraction, and a throttling member in said outlet line, said means for supplying control liquid comprising means defining an annular chamber for each valve, the drum having a calibrated bore communicating with the annular chamber for continuous flow of control fluid.

* * * * *

UNITED STATES PATENT AND TRADEMARK OFFICE

CERTIFICATE OF CORRECTION

PATENT NO. : 4,149,668

DATED : April 17, 1979

INVENTOR(S) : Hugo Zurbruggen

It is certified that error appears in the above–identified patent and that said Letters Patent are hereby corrected as shown below:

1. Col 4, line 5, change "parking" to --paring--.

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*